US007399060B2

(12) United States Patent
Tsuchii

(10) Patent No.: US 7,399,060 B2
(45) Date of Patent: Jul. 15, 2008

(54) INK JET RECORDING HEAD HAVING NOZZLE PORTION WITH DIFFERING SECTIONAL AREAS

(75) Inventor: Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 369 days.

(21) Appl. No.: 11/290,491

(22) Filed: Dec. 1, 2005

(65) Prior Publication Data

US 2006/0119663 A1 Jun. 8, 2006

(30) Foreign Application Priority Data

Dec. 7, 2004 (JP) ..... 2004-354072

(51) Int. Cl.
*B41J 2/14* (2006.01)
*B41J 2/16* (2006.01)

(52) U.S. Cl. ..... 347/47; 347/44

(58) Field of Classification Search ..... 347/20, 347/44, 46–47, 56, 62–65, 67, 92–94
See application file for complete search history.

(56) References Cited

U.S. PATENT DOCUMENTS

| | | | | |
|---|---|---|---|---|
| 5,398,053 | A | 3/1995 | Hirosawa et al. | 347/13 |
| 5,402,160 | A | 3/1995 | Kadowaki et al. | 347/18 |
| 5,451,989 | A | 9/1995 | Kakowaki et al. | 347/18 |
| 5,451,993 | A * | 9/1995 | Takahashi et al. | 347/47 |
| 5,512,924 | A | 4/1996 | Takada et al. | 347/18 |
| 5,828,387 | A | 10/1998 | Wataya et al. | 347/14 |
| 5,924,197 | A | 7/1999 | Murakami et al. | 29/890.1 |
| 6,130,688 | A * | 10/2000 | Agarwal et al. | 347/47 |
| 6,305,080 | B1 | 10/2001 | Komuro et al. | 29/890.1 |
| 6,652,079 | B2 | 11/2003 | Tsuchii et al. | 347/65 |
| 6,824,248 | B2 | 11/2004 | Tsuchii | 347/54 |
| 6,830,317 | B2 | 12/2004 | Tsuchii et al. | 347/56 |
| 6,926,392 | B2 * | 8/2005 | Sasaki et al. | 347/65 |
| 6,976,748 | B2 | 12/2005 | Yabe et al. | 347/43 |
| 6,984,025 | B2 | 1/2006 | Kaneko et al. | 347/61 |
| 6,988,786 | B2 | 1/2006 | Kaneko et al. | 347/44 |
| 7,077,503 | B2 | 7/2006 | Kaneko et al. | 347/48 |
| 7,172,264 | B2 | 2/2007 | Kaneko et al. | 347/47 |
| 2006/0044350 | A1 | 3/2006 | Tsuchii | 347/47 |
| 2006/0119663 | A1 | 6/2006 | Tsuchii | 347/47 |
| 2007/0035580 | A1 | 2/2007 | Ide et al. | 347/40 |
| 2007/0046733 | A1 | 3/2007 | Nabeshima et al. | 347/65 |

* cited by examiner

*Primary Examiner*—Juanita D Stephens
(74) *Attorney, Agent, or Firm*—Fitzpatrick, Cella, Harper & Scinto

(57) ABSTRACT

An ink jet recording head controls an impulse force generated at the time of disappearing of a bubble while keeping an energy efficiency of ink ejection high. The ink jet recording head has a discharge port from which ink is discharged, a pressure chamber by which energy for ejection is given to ink, and a nozzle portion which makes the pressure chamber and the discharge port communicate. The nozzle portion includes a major diameter portion with a sectional area larger than an area of the discharge port, and a minor diameter portion, whose sectional area is smaller than that of the major diameter portion, along an ink ejection direction, and the minor diameter portion is provided between the major diameter portion and the pressure chamber.

4 Claims, 6 Drawing Sheets

INK JET RECORDING HEAD HAVING NOZZLE PORTION WITH DIFFERING SECTIONAL AREAS

BACKGROUND OF THE INVENTION

1. Field of the Invention

The present invention relates to an ink jet recording head which ejects ink to a recording medium to record an image.

2. Related Background Art

An example of a conventional ink jet recording head (hereafter, this may be abbreviated a "recordinghead") is shown in FIGS. 7A, 7B, 8A and 8B. FIGS. 7A, 7B, 8A and 8B are enlarged sectional views near a discharge port 105 where ink is discharged. Below the discharge port 105, a pressure chamber 103 in which a heater 102 is provided, a nozzle portion 101 which makes the pressure chamber 103 and discharge port 105 communicate, and an ink flow path 106 for supplying ink to the pressure chamber 103 are provided. Ink supplied to the pressure chamber 103 through the ink flow path 106 is heated by heat generated by the heater 102, and is discharged by the pressure of a bubble, which is generated in the ink at that time, from the discharge port 105 through the nozzle portion 101.

The nozzle portion 101 of the recording head shown in FIGS. 7A and 7B has a constant area of a section which is orthogonal to an ink ejection direction. On the other hand, in the nozzle portion 101 of the recording head shown in FIGS. 8A and 8B, an area of this section becomes large as it is close to the pressure chamber 103. Hereafter, the nozzle portion 101 shown in FIGS. 7A and 7B may be called a "straight nozzle" and the nozzle portion 101 shown in FIGS. 8A and 8B may be called a "tapered nozzle" for distinguishment. Here, the ink flow resistance of a straight nozzle is large, and hence, its energy efficiency of ink ejection is low. Therefore, in order to raise the energy efficiency of ink ejection, a tapered nozzle with small flow resistance becomes mainstream.

For example, when a distance OH from the discharge port 105 to a top face of the heater 102 is 75 μm and the height H of the ink flow path is 20 μm, the thickness (length) of the nozzle portion 1 of both of the straight nozzle and tapered nozzle become 55 μm. In this case, the inertance and viscous resistance of each nozzle portion 101 become as shown in Table 1.

TABLE 1

| | | Straight nozzle | Tapered nozzle | | |
|---|---|---|---|---|---|
| | | | Taper 5° | Taper 12° | Taper 19° |
| Nozzle portion | Inertance | 1.12E−01 | 8.04E−02 | 5.72E−02 | 4.37E−02 |
| | Inertance ratio (%) | 100 | 72 | 51 | 39 |
| | Viscous resistance | 2.28E−04 | 1.22E−04 | 6.82E−05 | 4.51E−05 |
| | Viscous resistance ratio (%) | 100 | 54 | 30 | 20 |
| Pressure chamber | Ceiling portion area ($\mu m^2$) | 3358 | 2907 | 2010 | 743 |
| | Ceiling portion area ratio (%) | 100 | 87 | 60 | 22 |

The inertance and viscous resistance of the nozzle portion 101 act as resistance at the time of discharging ink, and when these are large, an ejection energy efficiency falls. The inertance and viscous resistance are expressed by the following formulas, respectively.

Inertance M (kPa/($\mu m^3/\mu s^2$))

$$M = \rho \int_0^{OP} dx / s(x)$$

where,

OP: thickness of nozzle portion

S(x): ink flow path sectional area in position of distance x from lower edge of nozzle portion ($\mu m^2$)

ρ: specific gravity of ink

Viscous resistance R (kPa/($\mu m^3/\mu s$))

$$R = \eta \int_0^{OP} D(x)\, dx / S(x)^2$$

where,

D(x) is a shape factor of a nozzle, and when a nozzle is a rectangular solid:

$$D(x)=12.0\times(0.33+1.02\times(a(x)/b(x)+b(x)/a(x)))$$

when a nozzle is a cylinder:

$$D(x)=8\pi$$

OP: thickness of nozzle portion

S(x): ink flow path sectional area in position of distance x from lower edge of nozzle portion ($\mu m^2$)

η: ink viscosity (Pa·s)

In addition, since the inertance and viscous resistance in Table 1 are used for relative comparison, they are obtained by simple calculation.

Specifically, inertance is calculated on condition of specific gravity ρ=1, and, viscous resistance is calculated on conditions of coefficient of sectional form of nozzle=1 and viscosity η=1e−3 Pa·s. This is common to all the values of inertances and viscous resistances described below. In order to obtain strict inertance, it is necessary to use the specific gravity of ink to be used, and in order to obtain the strict viscous resistance, it is necessary to calculate using a coefficient of sectional form D(x) adapted to the viscosity η of ink and a cross-sectional form of a nozzle to be used.

As shown in Table 1, it is understood on a straight nozzle that its inertance and viscous resistance are large and it is inefficient. On the other hand, on a tapered nozzle, both of inertance and viscous resistance become small as a taper angle is enlarged. Specifically, at 5° of taper angle, inertance becomes 72% and, viscous resistance becomes 54% to a straight nozzle. In addition, at 12° of taper angle, the inertance becomes 51%, which is nearly a half, and the viscous resistance becomes 30% to the straight nozzle. Furthermore, at 19° of taper angle, the inertance becomes 39%, and the viscous resistance becomes 20%, which is ⅕, to the straight nozzle. Thus, it is possible to raise an ejection energy efficiency sharply in a tapered nozzle by enlarging a taper angle.

Nevertheless, in a tapered nozzle as shown in FIGS. 8A and 8B, a ceiling portion area of the pressure chamber 103 shown by hatching in the figure becomes small as a taper angle becomes large (as to specific numerical values, refer to Table 1). The ceiling portion area of the pressure chamber 103 decreases to 87% of a straight nozzle at 5° of taper angle, decreases to 60% at 12° of taper angle, and decreases sharply to 22% at 19° of taper angle. Since the ceiling portion area of the pressure chamber 103 acts as resistance to the approximately horizontal motion of ink to the ceiling portion when a bubble disappears, the motion loss of the bubble in a bubble disappearing process becomes large, and an impulse force at the time of the bubble disappearing becomes weak as this resistance becomes large. In the tapered nozzle with small flow resistance, since the kinetic energy of ink in a horizontal direction in the pressure chamber 103 becomes large in addition to the kinetic energy of the ink in the nozzle portion 101 being large at the time of the bubble disappearing, the impulse force generated at the time of bubble disappearing also becomes very large. As a result, the impulse force generated at the time of the bubble disappearing, i.e., the impulse force generated at the time of cavitation collapse, becomes large, and there has been a resulting problem of the heater 102 being easily damaged.

SUMMARY OF THE INVENTION

The present invention can provide an ink jet recording head which controls an impulse force generated at the time of disappearing of a bubble while keeping an energy efficiency of ink ejection high.

The ink jet recording head of the present invention is characterized by comprising a discharge port from which ink is discharged, a pressure chamber by which energy for ejection is given to ink, and a nozzle portion which makes the pressure chamber and discharge port communicate, the nozzle portion including a major diameter portion with a larger sectional area than an area of the discharge port, and a minor diameter portion, whose sectional area is smaller than that of the major diameter portion, along an ink ejection direction, the minor diameter portion being provided in a position nearer to the pressure chamber than the major diameter portion.

According to the present invention, it is possible to reduce the flow resistance of the nozzle portion while avoiding the decrease of the ceiling area of the pressure chamber. Therefore, it is possible to control the impulse force generated inside the pressure chamber at the time of the bubble disappearing while keeping the energy efficiency of ink ejection high.

BRIEF DESCRIPTION OF THE DRAWINGS

FIG. 1A shows a section parallel to an ink ejection direction, and FIG. 1B is a diagram showing a section which is orthogonal to the ink ejection direction;

FIG. 7A shows a section parallel to an ink ejection direction, and FIG. 7B is a diagram showing a section which is orthogonal to the ink ejection direction; FIG. 8A shows a section parallel to an ink ejection direction, and FIG. 8B is a diagram showing a section which is orthogonal to the ink ejection direction.

DESCRIPTION OF THE PREFERRED EMBODIMENTS

Embodiment 1

Figure 1A:
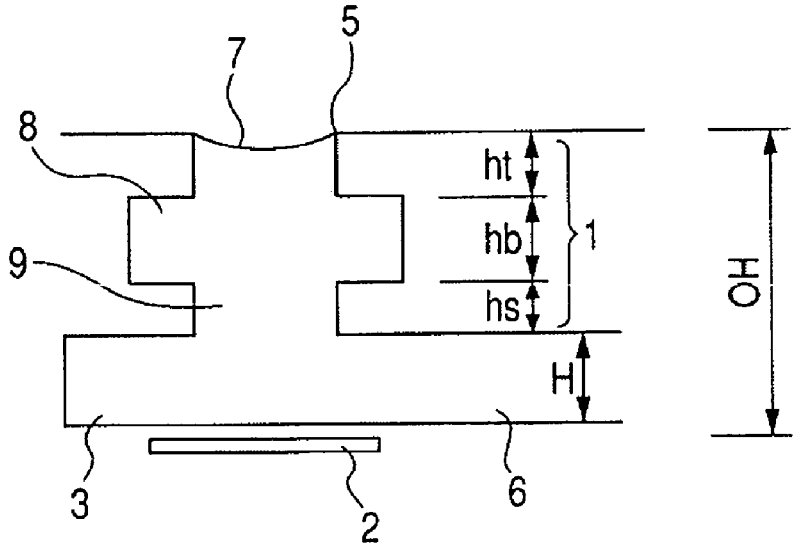
FIGS. 1A and 1B are sectional views showing an example of an embodiment of an ink jet recording head of the present invention.
Figure 1B:
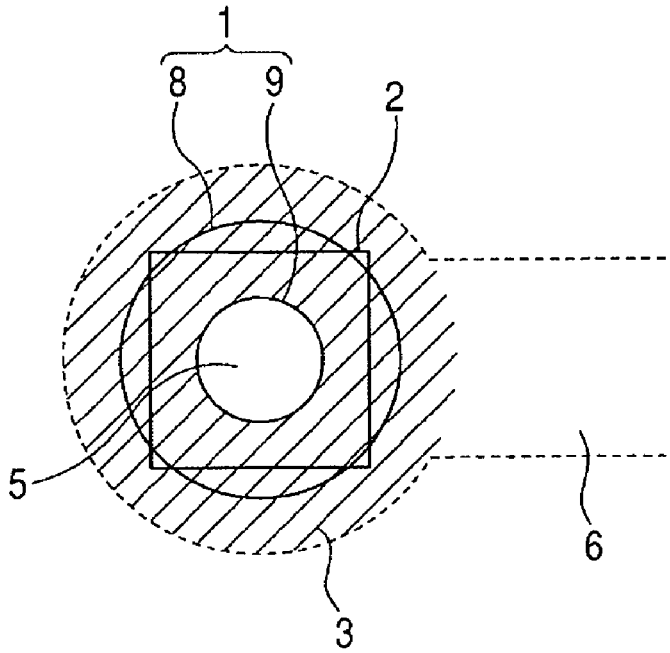

Hereafter, an example of an embodiment of the ink jet recording head of the present invention will be explained with reference to FIGS. 1A and 1B. FIGS. 1A and 1B are enlarged sectional views of a nozzle portion of the recording head of this embodiment. FIG. 1A shows a section parallel to an ink ejection direction, and FIG. 1B shows a section orthogonal to the ink ejection direction, respectively.

One end of the nozzle portion 1 communicates with a pressure chamber 3 in which a heater 2 is provided, and another end communicates with a discharge port 5 from which ink is discharged. Furthermore, an ink flow path 6 for supplying ink to the pressure chamber 3 communicates with the pressure chamber 3. The ink flow path 6 communicates with an ink supply opening not shown, and ink is supplied through this ink supply opening. The ink supplied from the ink supply opening is supplied to the pressure chamber 3 through the ink flow path 6. Usually, the pressure chamber 3 and nozzle portion 1 are filled with the ink supplied as mentioned above, and a meniscus 7 of the ink is formed in a discharge port 5. When the heater 2 generates heat in this state, the ink is heated by heat and a predetermined amount of ink (ink droplet) is discharged from the discharge port 5 by the pressure of a bubble generated in the ink.

A major diameter portion 8 with a larger sectional area than that of the discharge port 5 is formed in the middle of the nozzle portion 1 in the ink ejection direction, and a minor diameter portion 9 whose sectional area is smaller than that of the major diameter portion 8 is formed between the major diameter portion 8 and pressure chamber 3. Because of the major diameter portion 8, the flow resistance of the nozzle portion 1 is drastically smaller in comparison with that of a conventional straight nozzle. Here, Table 2 shows the inertance and viscous resistance of the nozzle portion 1 and ceiling portion area of the pressure chamber 3 in two structures A and B, which are different in distance ht from the discharge port 5 to the major diameter portion 8, height hb of the major diameter portion 8, and height hs of the minor diameter portion 9. It is common in the structure A and B that distance OH from the discharge port 5 to a top face of the heater 2 is 75 μm and the height H of the ink flow path 6 is 20 μm. In the structure A, ht=10 μm, hb=35 μm, and hs=10 μm, and in the structure B, ht=5 μm, hb=45 μm, and hs=5 μm.

TABLE 2

| | | Straight nozzle | Tapered nozzle Taper 5° | Taper 12° | Taper 19° | Structure of present invention A | B |
|---|---|---|---|---|---|---|---|
| Nozzle portion | Inertance | 1.12E−01 | 8.04E−02 | 5.72E−02 | 4.37E−02 | 5.86E−02 | 4.33E−02 |
| | Inertance ratio (%) | 100 | 72 | 51 | 39 | 52 | 39 |
| | Viscous resistance | 2.28E−04 | 1.22E−04 | 6.82E−05 | 4.51E−05 | 9.21E−05 | 5.32E−05 |
| | Viscous resistance ratio (%) | 100 | 54 | 30 | 20 | 40 | 23 |
| Pressure chamber | Ceiling portion area ($\mu m^2$) | 3358 | 2907 | 2010 | 743 | 3358 | 3358 |
| | Ceiling portion area ratio(%) | 100 | 87 | 60 | 22 | 100 | 100 |

The inertance of the nozzle portion of the structure A is 52% of that of a straight nozzle which is almost equal to that of a tapered nozzle with 12° of taper angle, and the inertance of the nozzle portion of the structure B is 39% of the straight nozzle, which is almost equal to that of a tapered nozzle with 19° of taper angle.

In addition, the viscous resistance of the structure A is 40% of the straight nozzle, which is close to that of the tapered nozzle with 12° of taper angle, and the viscous resistance of the structure B is 23% of the straight nozzle, which is dramatically close to that of the tapered nozzle with 19° of taper angle. Thus, it turns out that, according to the present invention, the resistance of a nozzle portion is reduced sharply and the ejection energy efficiency improves remarkably.

On the other hand, the ceiling portion area of the pressure chamber in structures A and B is maintained at the same area as the straight nozzle in each of the structures A and B as shown in Table 3. Hence, the motion loss of ink approximately parallel to the ceiling of the pressure chamber at the time of the bubble disappearing is sharply reduced in comparison with the conventional tapered nozzle. As a result, the impulse force generated at the time of disappearing of a bubble becomes weaker, damage to the heater is reduced, and heater lifetime is extended greatly.

TABLE 3

| | Protrusion | | Straight nozzle | Tapered nozzle Taper 5° | Taper 12° | Taper 19° | Structure of present invention A | B |
|---|---|---|---|---|---|---|---|---|
| Pressure chamber | Not present | Ceiling portion area ($\mu m^2$) | 3358 | 2907 | 2010 | 743 | 3358 | 3358 |
| | | Ceiling portion area ratio (%) | 100 | 87 | 60 | 22 | 100 | 100 |
| | Present | Ceiling portion area ($\mu m^2$) | 3433 | 3013 | 2159 | 938 | | |
| | | Ceiling portion area ratio (%) | 102 | 90 | 64 | 28 | | |

As described above, according to the present invention, it is possible to control the impulse force generated at the time of the disappearing of a bubble, to suppress damage to a heater, and to exponentially prolong the disconnection lifetime of the heater, while keeping the energy efficiency of ink ejection high.

In addition, also in any of a conventional straight nozzle and a tapered nozzle, a convex protrusion may be generated around a bottom end portion of a discharge port depending on manufacturing process. However, the size of this protrusion is about at most 1 μm, and most effects which it has on a ceiling portion area of a pressure chamber can be disregarded. Specifically, when a taper angle is 5°, the ceiling portion area of the pressure chamber of a tapered nozzle becomes to the extent of 90% to a straight nozzle when there is a protrusion, although it is 87% when there is no protrusion. In addition, when the taper angle is 12°, the ceiling portion area of the pressure chamber of the tapered nozzle becomes to the extent of 64% to the straight nozzle when there is a protrusion, although it is 60% when there is no protrusion. Furthermore, when the taper angle is 19°, the ceiling portion area of the pressure chamber of the tapered nozzle becomes to the extent of 28% to the straight nozzle when there is a protrusion, although it is 22% when there is no protrusion.

As mentioned above, it is possible to disregard most effects which a convex protrusion of the order of 1-μm generated around a bottom end portion of the discharge port in manufacturing process has on the ceiling portion area of a pressure chamber, i.e., effects which it has on the approximately horizontal motion of ink to the ceiling portion.

Figure 2A:
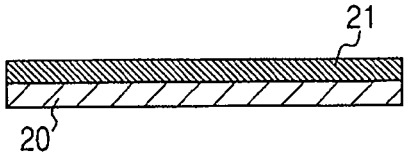
FIGS. 2A, 2B, 2C, 2D, 2E, 2F, 2G, 2H and 2I are sectional views showing the manufacturing process of the recording head in FIGS. 1A and 1B.
Figure 2B:
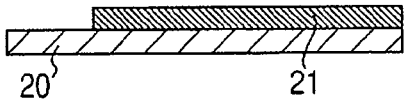
Figure 2C:
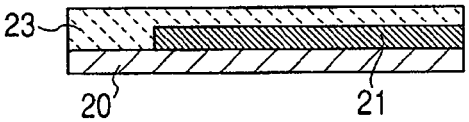
Figure 2D:
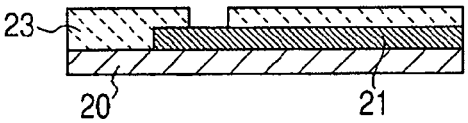
Figure 2E:
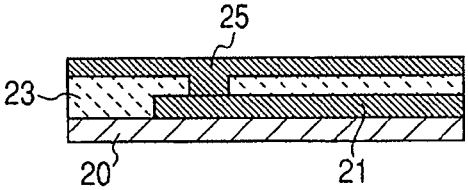
Figure 2F:
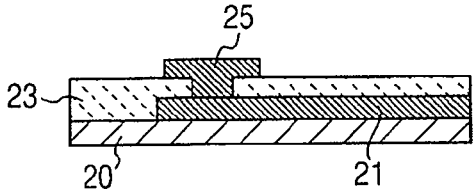
Figure 2G:
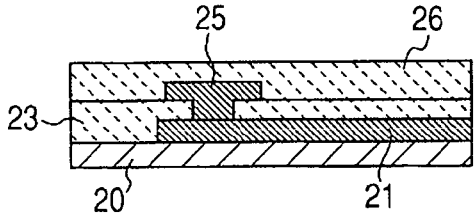
Figure 2H:
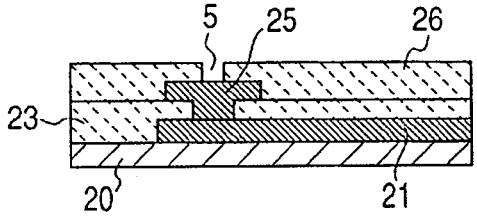
Figure 2I:
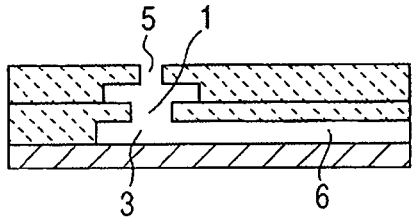

Next, FIGS. 2A to 2I show the manufacturing process of the recording head of this embodiment. First, a positive type die material 21 is coated on a substrate 20 where a heater (not shown) is formed (FIG. 2A). Then, the die material 21 is exposed and developed, and a pattern equivalent to a desired ink flow path is formed (FIG. 2B). Next, a negative type nozzle material 23 is coated on the die material 21 (FIG. 2C), portions other than a portion which serves as a minor diameter portion of a nozzle portion finally are exposed and developed, and the nozzle material 23 in the portion equivalent to the minor diameter portion is removed (FIG. 2D). Next, a die material 25 is coated again (FIG. 2E), portions other than a portion which finally serves as a major diameter portion are exposed and developed, and the die materials 25 in other than the portion equivalent to the major diameter portion are removed (FIG. 2F). Then, a nozzle material 26 is coated again (FIG. 2G), portions other than a portion equivalent to a discharge port are exposed and developed, and the discharge port 5 is formed (FIG. 2H). Finally, all the die material 23 is developed, and the nozzle portion 1, pressure chamber 3, and ink flow path 6 are formed (FIG. 2I).

Embodiment 2

Figure 3:
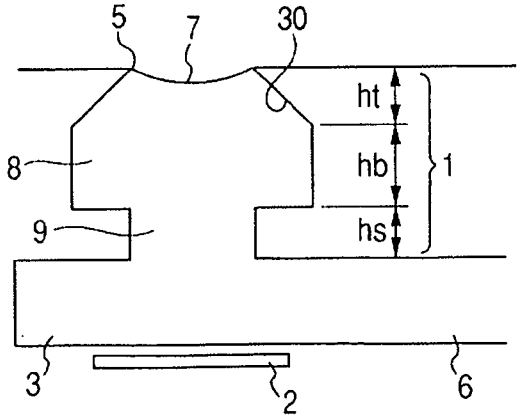
FIG. 3 is a sectional view showing another example of an embodiment of the ink jet recording head of the present invention, and is a diagram of a section parallel to the ink ejection direction.

Hereafter, a second embodiment of the present invention will be described with reference to FIG. 3. The basic constitution of the recording head of this embodiment is the same as that of the recording head of the first embodiment. The difference is that a taper portion which tapers off gradually from a side of the major diameter portion 8 toward the discharge port 5 is provided between the discharge port 5 and major diameter portion 8. In the recording head of this embodiment, since the flow resistance of ink which passes a taper portion 30 becomes small by providing the taper portion 30, the flow resistance of the entire nozzle portion 1 is further reduced by keeping the distance ht from the discharge port 5 to the major diameter portion 8, the height hb of the major diameter portion 8, and the height hs of the minor diameter portion 9 the same as those in the first embodiment. As a result, it becomes possible to further increase ejection energy efficiency in comparison with that of the recording head in the first embodiment. In addition, since the ceiling portion area of the pressure chamber 3 is kept the same as that of the recording head in the first embodiment, an impulse force generated at the time of disappearing of a bubble is controlled, damage to the heater 2 is suppressed, and the disconnection lifetime of the heater 2 is prolonged exponentially.

Embodiment 3

Figure 4:
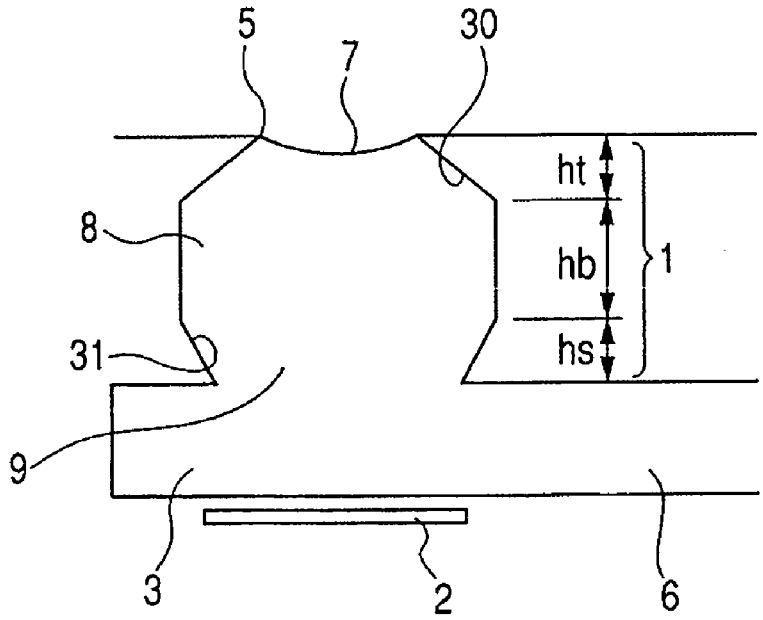
FIG. 4 is a sectional view showing still another example of an embodiment of the ink jet recording head of the present invention, and is a diagram of a section parallel to the ink ejection direction.

Hereafter, a third embodiment of the present invention will be described with reference to FIG. 4. The basic constitution of a recording head of this embodiment is the same as that of the recording head in the second embodiment. The difference is that a minor diameter portion 9 is formed by providing a taper in a wall surface 31 between the minor diameter portion 9 of the nozzle portion 1 and the pressure chamber 3 so that the nozzle portion 1 may taper off gradually toward the pressure chamber 3.

In the recording head of this embodiment, the flow resistance of the nozzle portion 1 becomes even smaller by a synergistic effect of the taper portion 30 between the major diameter portion 8 and discharge port 5, and the taper (taper in a direction reverse to that of the taper portion 30) of the minor diameter portion 9. Therefore, it is possible to further reduce the flow resistance of the entire nozzle portion 1 while keeping the distance ht from the discharge port 5 to the major diameter portion 8, the height hb of the major diameter portion 8, and the height hs of the minor diameter portion 9 the same as those in the second embodiment. As a result, it becomes possible to further increase ejection energy efficiency in comparison with that of the recording head in the second embodiment. In addition, since the ceiling portion area of the pressure chamber 3 is kept the same as that of the recording head in the second embodiment, an impulse force generated at the time of disappearing of a bubble is controlled, damage to the heater 2 is suppressed, and the disconnection lifetime of the heater 2 is prolonged exponentially.

Embodiment 4

Figure 5:
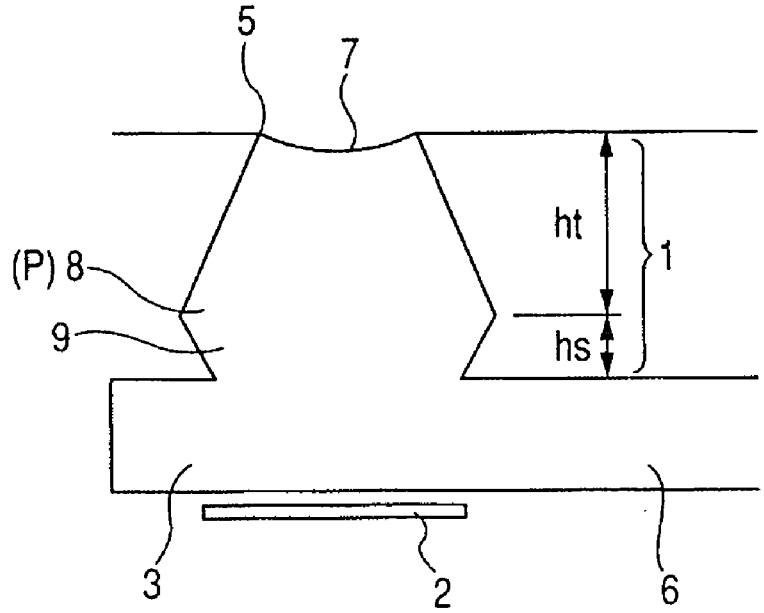
FIG. 5 is a sectional view showing a further example of an embodiment of the ink jet recording head of the present invention, and is a diagram of a section parallel to the ink ejection direction.

Hereafter, a fourth embodiment of the present invention will be described with reference to FIG. 5. The recording head of this embodiment is characterized by not only forming the major diameter portion 8 by providing taper in a position nearer to a side of the discharge port 5 than an arbitrary position P of the nozzle portion 1 in an ink ejection direction so that a sectional area may be gradually enlarged toward the pressure chamber 3 from the discharge port 5, but also forming the minor diameter portion 9 by providing reverse taper in a position nearer to a side of the pressure chamber 3 than the above-mentioned position P, so that a sectional area may reduce toward the pressure chamber 3 gradually. The recording head of this embodiment also affects the impulse force generated at the time of the disappearing of a bubble by reducing the flow resistance of the entire nozzle portion 1, and increasing the ejection energy efficiency.

Figure 6A:
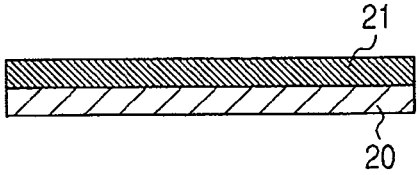
FIGS. 6A, 6B, 6C, 6D, 6E, 6F and 6G are sectional views showing the manufacturing process of the recording head in FIG. 5.
Figure 6B:
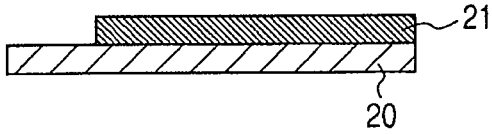
Figure 6C:
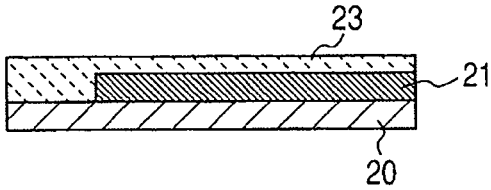
Figure 6D:
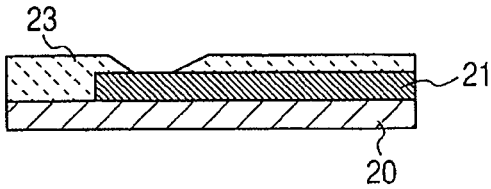
Figure 6E:
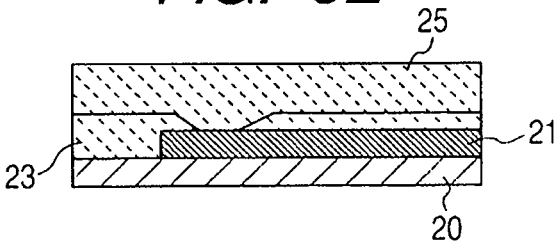
Figure 6F:
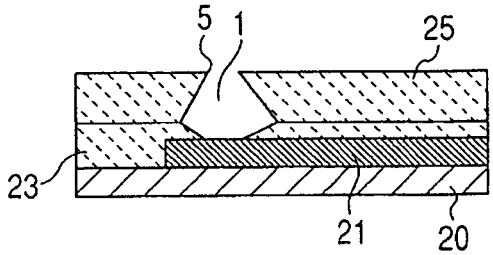
Figure 6G:
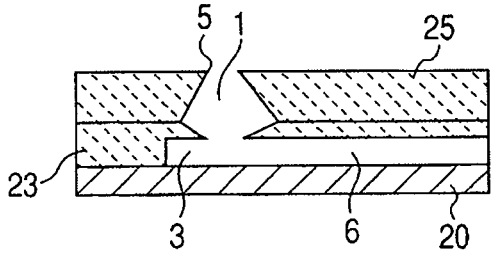
Figure 7A:
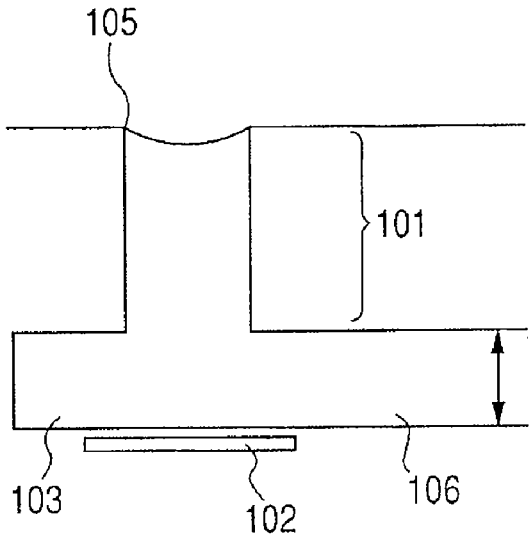
PRIOR ART FIG. 7A
FIGS. 7A and 7B are sectional views showing an example of a conventional ink jet recording head.
Figure 7B:
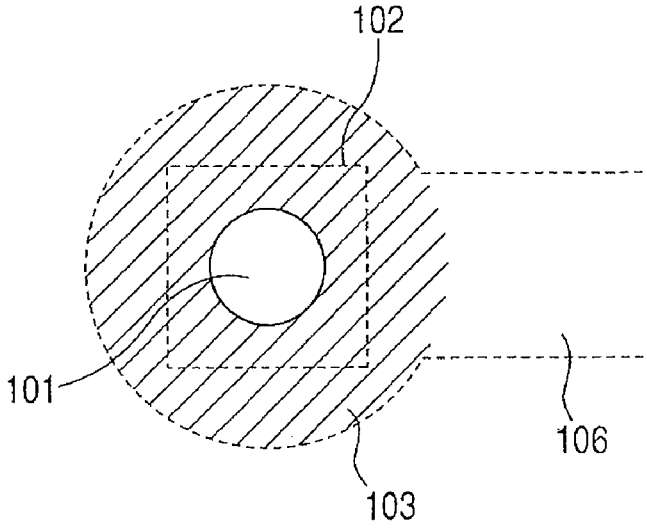
PRIOR ART FIG. 7B
Figure 8A:
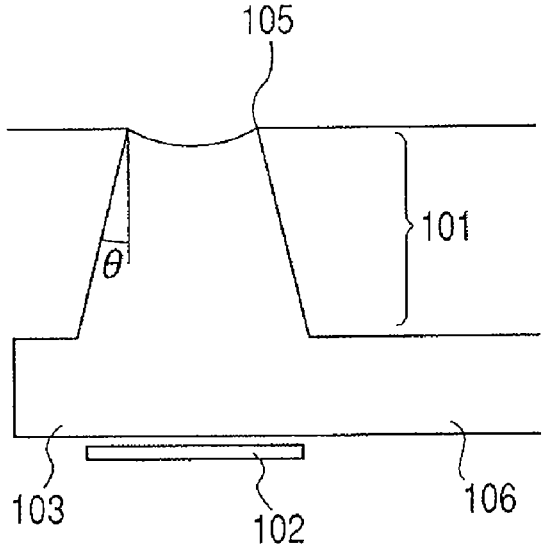
PRIOR ART FIG. 8A
FIGS. 8A and 8B are sectional views showing another example of an embodiment of the conventional ink jet recording head.
Figure 8B:
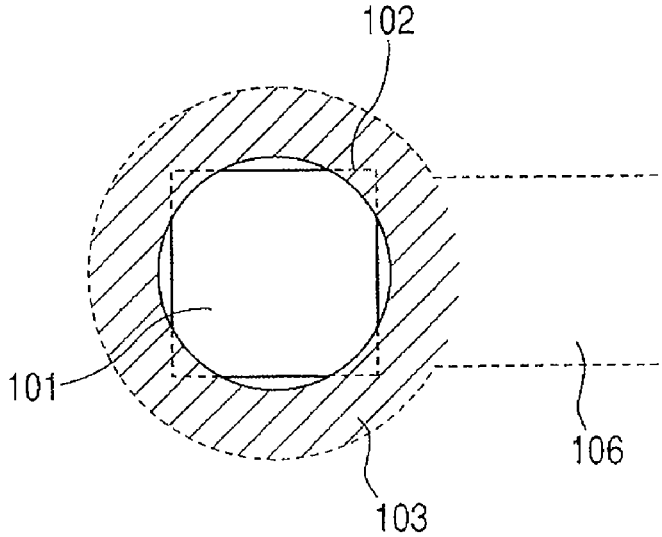
PRIOR ART FIG. 8B

FIGS. 6A to 6G show the manufacturing process of the recording head of this embodiment. First, the positive type die material 21 is coated on the substrate 20 where a heater (not shown) is formed (FIG. 6A). Then, the die material 21 is exposed and developed, and a pattern equivalent to a desired ink flow path is formed (FIG. 6B). Next, the negative type nozzle material 23 is coated on the die material 21 (FIG. 6C). The steps so far are the same as the manufacturing process of the recording head of the first embodiment. Next, exposure and development are performed so that the above-mentioned reverse taper may be formed in a portion equivalent to a minor diameter portion by making a mask for forming an exposure pattern offset from a surface of the nozzle material 23 by a predetermined amount when exposing portions other than the portion which finally serves as the minor diameter portion (FIG. 6D). Here, the die material 25 is coated again (FIG. 6E), exposure and development are performed by adjusting the distance between the mask and the surface of the die material 25 so that the above-mentioned taper (major diameter portion) may be formed, and then, the discharge port 5 and nozzle portion 1 (the minor diameter portion 9 and major diameter portion 8) are formed (FIG. 6F). Finally, the entire die material 21 is removed, and the pressure chamber 3 and ink flow path 6 are formed (FIG. 6G).

As described above, since the recording head of this embodiment can be produced by a process that is simpler than that of the recording head in the first, second and third embodiments, manufacturing cost is greatly reduced.

This application claims priority from Japanese Patent Application No. 2004-354072 filed on Dec. 7, 2004, which is hereby incorporated by reference herein.

What is claimed is:

1. An ink jet recording head, comprising:

a discharge port from which ink is discharged;

a pressure chamber by which energy for ejection is applied to ink; and a nozzle portion through which the pressure chamber and the discharge port communicate, wherein the nozzle portion includes a major diameter portion with a sectional area larger than an area of the discharge port, and a minor diameter portion with a sectional area smaller than that of the major diameter portion, along an ink ejection direction, and the minor diameter portion is provided at a position nearer to the pressure chamber than the major diameter portion.

2. The ink jet recording head according to claim 1, wherein a taper portion which tapers off gradually toward the discharge port is provided between the discharge port and the major diameter portion.

3. The ink jet recording head according to claim 1, wherein a sectional area of the minor diameter portion decreases toward the pressure chamber.

4. The ink jet recording head according to claim 1, wherein an electrothermal transducing element which heats ink inside the pressure chamber to generate a bubble in the ink is provided inside the pressure chamber, and the ink is discharged from the discharge port by pressure at the time of the generating of a bubble.

* * * * *

UNITED STATES PATENT AND TRADEMARK OFFICE

CERTIFICATE OF CORRECTION

PATENT NO. : 7,399,060 B2
APPLICATION NO. : 11/290491
DATED : July 15, 2008
INVENTOR(S) : Tsuchii It is certified that error appears in the above-identified patent and that said Letters Patent is hereby corrected as shown below:

COLUMN 1:
Line 13, “recordinghead” should read --recording head--.

COLUMN 5:
Line 38, “time of” should read --time of the--.

Signed and Sealed this

Tenth Day of March, 2009

JOHN DOLL
*Acting Director of the United States Patent and Trademark Office*